US008651831B2

(12) United States Patent
Yagi et al.

(10) Patent No.: US 8,651,831 B2
(45) Date of Patent: Feb. 18, 2014

(54) SYSTEM FOR REDUCING COMPRESSOR NOISE AND SUSPENSION SPRING AND SNUBBER ARRANGEMENT THEREFOR

(75) Inventors: Akio Yagi, Kanagawa (JP); Kar Hoe Chan, Singapore (SG); Hideki Kawai, Singapore (SG); Hiroshi Sasano, Singapore (SG); Chew Thong Khoo, Singapore (SG)

(73) Assignee: Panasonic Refrigeration Devices Singapore Pte Ltd, Singapore (SG)

( * ) Notice: Subject to any disclaimer, the term of this patent is extended or adjusted under 35 U.S.C. 154(b) by 1348 days.

(21) Appl. No.: 11/148,234

(22) Filed: Jun. 9, 2005

(65) Prior Publication Data

US 2006/0024175 A1 Feb. 2, 2006

(30) Foreign Application Priority Data

Jul. 28, 2004 (SG) ..... 200404154-7

(51) Int. Cl.
*F16F 1/16* (2006.01)

(52) U.S. Cl.
USPC ..... 417/363; 417/423.15; 267/287; 267/291

(58) Field of Classification Search
USPC ..... 417/363, 423.15; 267/287, 291, 170, 267/179
See application file for complete search history.

(56) References Cited

U.S. PATENT DOCUMENTS

| | | | | | |
|---|---|---|---|---|---|
| 3,030,056 | A * | 4/1962 | Rogers | 248/565 |
| 3,531,069 | A | 9/1970 | Dubberley | |
| 3,563,526 | A * | 2/1971 | Mui | 267/178 |
| 3,578,279 | A * | 5/1971 | Scheldorf | 248/624 |
| 4,199,454 | A * | 4/1980 | Sartore | 210/222 |
| 4,549,859 | A * | 10/1985 | Andrione et al. | 417/363 |
| 4,686,926 | A * | 8/1987 | Vance | 114/230.18 |
| 4,712,778 | A * | 12/1987 | Newman | 267/170 |
| 5,246,215 | A * | 9/1993 | Takamura et al. | 267/170 |
| 5,772,191 | A * | 6/1998 | Nakano et al. | 267/289 |
| 5,934,884 | A | 8/1999 | Son | |
| 6,004,113 | A | 12/1999 | Vay | |
| 6,341,588 | B2 * | 1/2002 | Kobayashi et al. | 123/90.67 |
| 6,485,271 | B1 * | 11/2002 | Tack | 417/363 |
| 7,357,381 | B2 * | 4/2008 | Wakamori et al. | 267/179 |
| 2002/0127123 | A1 | 9/2002 | Lee | |

* cited by examiner

*Primary Examiner* — Christopher Bobish
(74) *Attorney, Agent, or Firm* — Pyprus Pte Ltd

(57) ABSTRACT

The present invention comprises a suspension spring and snubber arrangement for reducing transmitted noise from a reciprocating compressor at ⅓-octave frequency band of 500 Hz and preventing the occurrence of resonance frequency during the reciprocating compressor operation, the arrangement comprising: the suspension spring having a plurality of coils and two opposing open ends; at least one snubber for maintaining the integrity and shape of the suspension spring and for preventing displacement of the suspension spring from their intended position; wherein at least one open end of the suspension spring is loosely fitted over the at least one snubber; and further wherein an internal diameter of the suspension spring is larger than a outer diameter of the snubber so that a gap is defined between the suspension spring and the snubber for minimizing physical contact between the suspension spring and the snubber.

4 Claims, 3 Drawing Sheets

SYSTEM FOR REDUCING COMPRESSOR NOISE AND SUSPENSION SPRING AND SNUBBER ARRANGEMENT THEREFOR

FIELD OF THE INVENTION

The present invention generally relates to reducing transmitted noise and vibration from reciprocating compressors. In particular, the invention relates to a system for reducing transmitted noise and vibration from reciprocating compressors and a suspension spring and snubber arrangement therefor.

BACKGROUND OF THE INVENTION

Reduction of transmitted noise from hermetic compressors have long been a concern for domestic appliance manufacturers, particularly in compressors for refrigeration appliances.

Many of these appliances utilize reciprocating compressors. Referring to FIG. 1, a cutaway view of an example of a typical hermetic compressor 10 as installed in a refrigeration appliance is shown. The hermetic compressor 10 comprises a motor 12 having a crankshaft 14 coupled to a connecting rod 16. The connecting rod 16 is coupled to a piston (not shown) which is housed inside the cylinder head 18. The connecting rod 16, the piston and the cylinder head 18 together form the pump assembly 20 of the hermetic compressor 10. The pump assembly 20 and the motor 12 together form the compressor assembly 23.

During operation, the crankshaft 14 of the motor 12 rotates at a predetermined speed. This rotary motion is translated into a linear reciprocating motion via the connecting rod 16 coupled to the piston.

Noise is generated by the rotating motion of the motor 14 and also from vibrations of the reciprocating connecting rod 16 and piston of the pump assembly 20. This noise is partially suppressed by a hermetic shell 30 that encloses compressor assembly 23.

An oil lubrication system (not shown) is also incorporated into the hermetic compressor 10 for providing lubricating oil to the rotating crankshaft 14 of the motor 12 and other moving parts. The lubricating oil collects in the bottom of the hermetic shell 30 and the crankshaft 14 is partially submerged in the lubricating oil. The lubricating oil thus also acts as a transmission medium for vibrations from the compressor assembly 23 to the hermetic shell 30.

The hermetic shell 30 is typically supported by a mount 25 for installation within the refrigeration appliance. Noise and vibration can however be mechanically transmitted through the hermetic shell 30 via the mount 25 to the refrigeration appliance.

A refrigeration line system which carries refrigerant from the compressor assembly 23 for cooling the refrigeration appliance is also a source of mechanical transmission of noise. The refrigeration line system has a pipeline leading from the compressor assembly 23 that goes through the hermetic shell 30. A discharge line 22 is firmly attached to the hermetic shell 30 at points where the discharge line 22 goes through the hermetic shell 30. Noise and vibration of the compressor assembly 23 can thus be transmitted via the discharge line 22 out of the hermetic compressor 10.

Damping of vibrations from the hermetic compressor 10 have presently been done by mounting the entire compressor assembly 23 on suspension springs 40 inside the hermetic shell 30. The vibrations and noise are thus dampened by the suspension springs 40 before being mechanically transmitted to the mount 25 that supports the hermetic compressor 10.

The suspension springs 40 are further augmented by snubbers 45 which help maintain the integrity and shape of the suspension springs 40 and also prevent the suspension springs 40 from being displaced from their intended positions. The suspension springs 40 are typically helical springs made up of a plurality of coils having two opposing open ends which define a circular tubular space within their helix shape. The snubbers 45 can be described to be substantially cylindrical and are typically small protrusions that fit into the open ends of the suspension spring 40.

Referring to FIG. 2, the snubbers 45 are typically used in pairs for each suspension spring 40. An upper snubber 45*a* is attached to the compressor assembly 23 and a corresponding lower snubber 45*b* attached to the lower portion of the hermetic shell 30. The upper snubber 45*a* is substantially aligned with the lower snubber 45*b* and allows the upper snubber 45*a* to be fitted into one end of the suspension spring 40 and the lower snubber 45*b* to be fitted into the opposing end of the same suspension spring 40.

For ease of manufacturing and assembly, the suspension spring 40 is firmly attached to at least one of the snubbers 45. This allows for ease of fitting of the corresponding upper snubber 45*a* or lower snubber 45*b* into the opposing open end of the suspension spring 40.

However, this firm attachment of the suspension spring 40 to at least one of the snubbers 45 have a noise frequency of around 500 Hz. When this noise frequency coincides with operating frequencies of the hermetic compressor 10, the total noise and vibration experienced will be amplified and cause a substantial noise concern.

Furthermore, interference fit between the suspension spring 40 and the snubbers 45 changes the noise resonance frequency as the interference fit changes. The interference fit is the amount of tolerance or space between the suspension spring 40 and the snubbers 45.

Therefore, a need clearly exists for a method and apparatus that reduces the noise transmitted from compressors, or at least alleviate limitations of existing damping techniques.

SUMMARY OF THE INVENTION

The present invention seeks to provide a system for reducing transmitted noise and vibration from reciprocating compressors and a suspension spring and snubber arrangement therefor.

Accordingly, in one aspect, the present invention provides, a suspension spring and snubber arrangement for reducing transmitted noise from a reciprocating compressor at ⅓-octave frequency band of 500 Hz and preventing the occurrence of resonance frequency during the reciprocating compressor operation, the arrangement comprising: the suspension spring having a plurality of coils and two opposing open ends; at least one snubber for maintaining the integrity and shape of the suspension spring and for preventing displacement of the suspension spring from their intended position; wherein at least one open end of the suspension spring is loosely fitted over the at least one snubber; and further wherein an internal diameter of the suspension spring is larger than a outer diameter of the snubber so that a gap is defined between the suspension spring and the snubber for minimizing physical contact between the suspension spring and the snubber.

In another aspect, the present invention provides, a system for reducing transmitted noise from a reciprocating compressor at ⅓-octave frequency band of 500 Hz and preventing the occurrence of resonance frequency during the compressor operation, the system comprising: a plurality of suspension springs each having a plurality of coils and two opposing open ends for supporting a compressor assembly of the reciprocating compressor; a plurality of upper snubbers mounted on a bottom side of the compressor assembly; a plurality of lower snubbers mounted on a frame; the plurality of upper snubbers substantially aligned with the plurality of lower snubbers, the plurality of suspension springs having their two opposing open ends fitted to the plurality of upper snubbers and the plurality of lower snubbers; wherein at least one of the two opposing open ends of each of the plurality of suspension springs is loosely fitted over the at least one of the plurality of upper and lower snubbers; and further wherein an internal diameter each of the plurality of suspension springs is larger than an outer diameter of the at least one of the plurality of upper and lower snubbers so that a gap is defined between the each of the plurality of suspension spring and the at least one of the plurality of upper or lower snubbers for minimizing physical contact between the each of the plurality of suspension springs spring and the at least one of the plurality of upper and lower snubbers.

BRIEF DESCRIPTION OF THE DRAWINGS

A first and second embodiment of the present invention will now be more fully described, with reference to the drawings of which.

DETAILED DESCRIPTION OF THE DRAWINGS

A system for reducing transmitted noise and vibration from reciprocating compressors and a suspension spring and snubber arrangement therefor, in accordance with a first and second embodiment of the invention are described. In the following description, details are provided to describe the embodiments. It shall be apparent to one skilled in the art, however, that the invention may be practiced without such details. Some of these details may not be described at length so as not to obscure the invention.

There are several advantages of the embodiments of the present invention. One advantage is the damping or the reduction of amplitude of noise at ⅓-octave frequency band of 500 Hz.

Another advantage of the embodiments of the present invention is the shifting of noise frequency of suspension spring 40 and snubber 45 away from the operating frequencies of the reciprocating compressor to prevent the occurrence of noise resonance during the compressor operation.

Yet another advantage of the embodiments of the present invention is the capability to act as a metallic dust trap for trapping metal particles from entering the oil lubrication system of the compressor.

Figure 1:
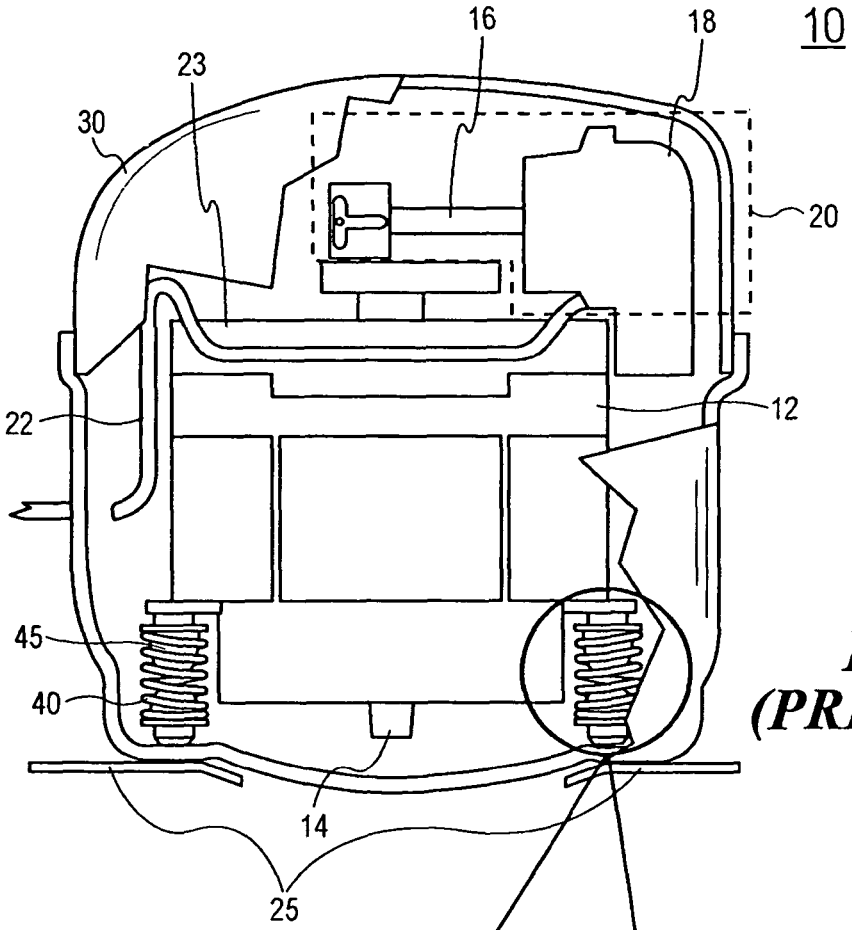
FIG. 1 (PRIOR ART)
FIG. 1 illustrates a cutaway view of a prior art hermetic compressor.
Figure 2:
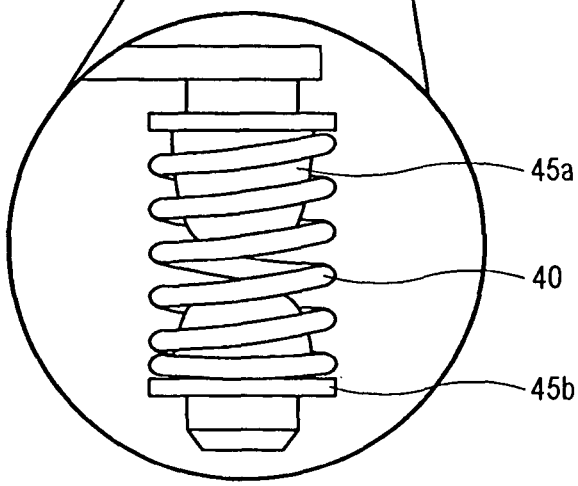
FIG. 2 (PRIOR ART)
FIG. 2 illustrates a prior art suspension spring and snubber arrangement of FIG. 1.
Figure 3A:
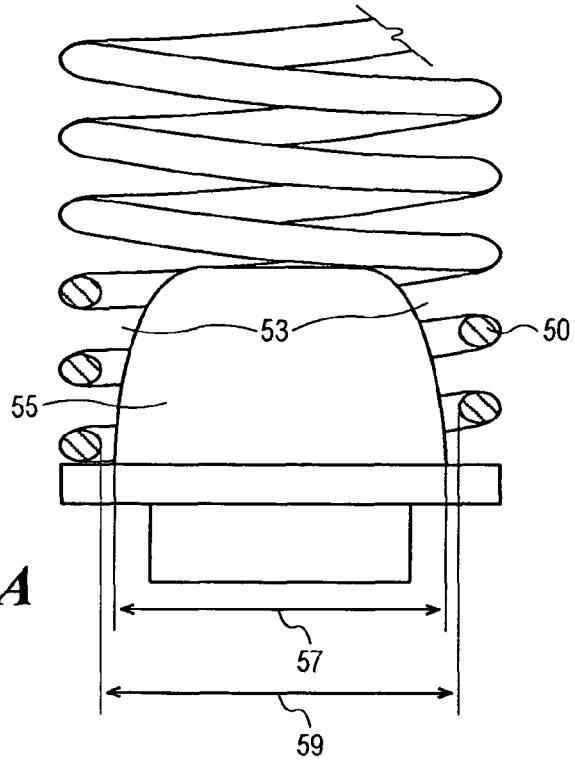
FIG. 3A illustrates a suspension spring and modified snubber arrangement in accordance with a first embodiment of the present invention.

Referring to FIG. 3A, a suspension spring 50 and lower snubber 55 arrangement in accordance with a first embodiment of the present invention is shown. The suspension spring 50 is made up of a plurality of coils and has two opposing open ends which define a circular tubular space within their helix shape. One open end of the suspension spring 50 is loosely fitted over the snubber 55, such that the suspension spring 50 reduces physical contact with the snubber 55. Internal diameter 59 of the suspension spring 50 is larger than the diameter 57 of the snubber 55.

This loose fitting of the suspension spring 50 over the snubber 55 moves away from prior art manufacturing practices of having the suspension spring 50 firmly attached to the snubber 55. The loose fitting arrangement may result in inconveniences during fitting of the suspension spring 50 to snubber 55, but the advantages of the first embodiment of the present invention outweighs the inconveniences.

Figure 3B:
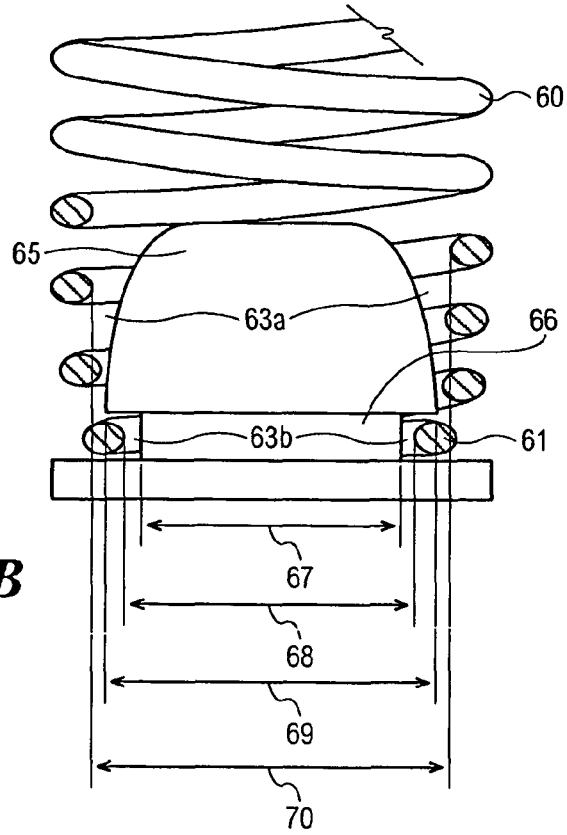
FIG. 3B illustrates a suspension spring and snubber arrangement in accordance with a second embodiment of the present invention.

Referring to FIG. 3B, a suspension spring 60 and modified snubber 65 arrangement in accordance with a second embodiment of the present invention is shown. One open end of the suspension spring 60 is also loosely fitted over the snubber 65, such that the suspension spring 60 reduces physical contact with the snubber 65. However to ensure that the suspension spring 60 does not slip off or fall away from the snubber 65, the modified snubber 65 is further provided with a groove 66 at or near the base of the modified snubber 65.

The suspension spring 60 is further adapted such that the open end of the suspension spring that fits over the modified snubber 65 is made up of at least one coil 61 having a smaller internal diameter 68 than the internal diameter 70 of the suspension spring 60. The smaller internal diameter 68 of the coil 61 is also smaller than that of a outer diameter 69 of the modified snubber 65. Groove diameter 67 of the modified snubber 65 at the groove 66 is smaller than the smaller internal diameter 68 of the at least one coil 61 and also smaller than the outer diameter 69 of the modified snubber 65.

The groove 66 and the coil 61 having the smaller internal diameter 68 together ensures that the suspension spring 60 does not slip off or fall away from the modified snubber 65.

However, a first gap 63*a* is maintained between the suspension spring 60 and the modified snubber 65. Furthermore, a second gap 63*b* is also maintained between the coil 61 having the smaller internal diameter 68 and the groove 66 of the modified snubber 65. The internal diameter 70 of the suspension spring 60 and the smaller internal diameter 68 of the coil 61 are still larger than the outer diameter 69 and groove diameter 67 respectively, of the modified snubber 65.

In the first and second embodiments of the present invention, the gaps 53, 63*a*, 63*b* serves to minimize or prevent physical contact between the suspension springs 50, 60 and the snubbers 55, 65. Furthermore, lubricating oil in the hermetic compressor 10 will likely spill into the gaps 53, 63*a* and 63*b* during operation. This thin film of lubricating oil in the gaps 53, 63*a* and 63*b* between the suspension springs 50, 60 and the snubbers 55, 65 further add to the damping or the reduction of amplitude of noise at ⅓-octave frequency band of 500 Hz.

Figure 4:
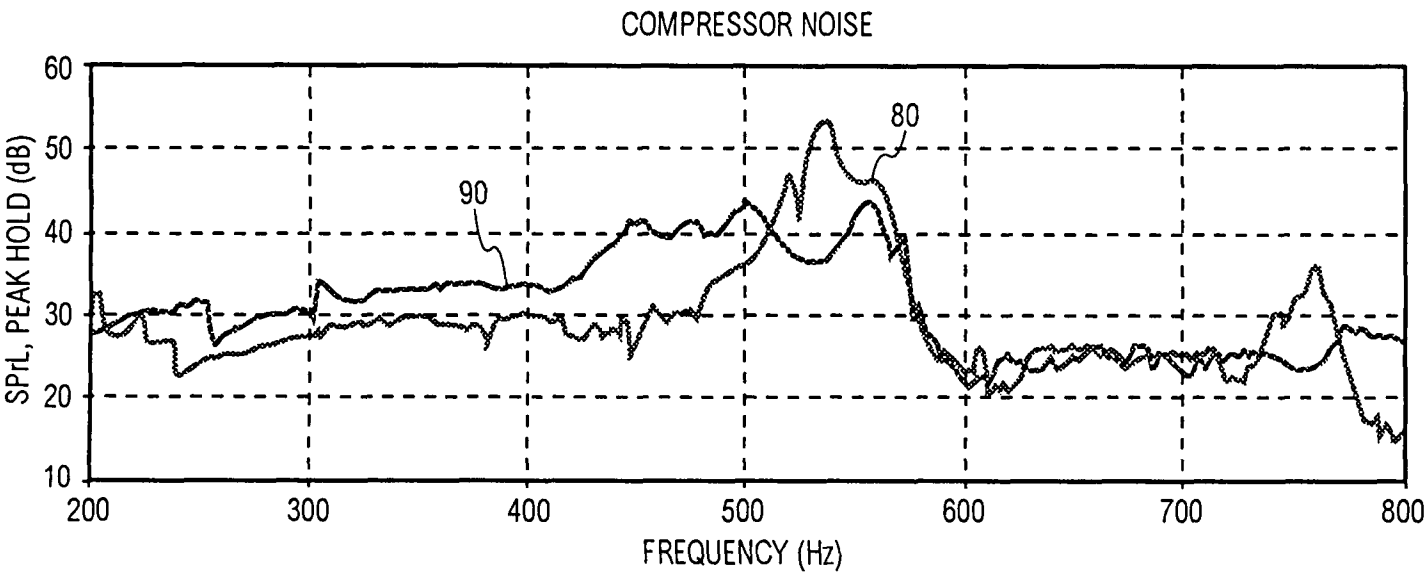
FIG. 4 illustrates a graph comparing noise performance of a prior art hermetic compressor and a hermetic compressor in accordance with an embodiment of the present invention.

Referring to FIG. 4, a graph comparing noise performance of a prior art hermetic compressor and a hermetic compressor in accordance with an embodiment of the present invention is shown. Line 80 represents the noise performance of the prior art hermetic compressor 10. The noise amplitude of line 80 at about 500 Hz is in excess of 50 dB. However, line 90 which represents the noise performance of the hermetic compressor 10 in accordance with the present invention exhibits a very much reduced noise amplitude of about 40 dB to 45 dB across the same range.

The first and second embodiments of the present invention can further be modified to act as a metallic dust trap for trapping metal particles from entering the oil lubrication system of the hermetic compressor 10. The suspension spring 50, 60 can further be magnetized so that the suspension spring 50, 60 may be prevented from slipping off the snubber 55, 65 by magnetic force. The magnetization of the suspension spring 50, 60 may also be used to attract metallic particles in the hermetic compressor 10, particularly in the lubricating oil and prevent the metallic particles from entering into the oil lubricating system.

It will be appreciated that various modifications and improvements can be made by a person skilled in the art without departing from the scope of the present invention.

The invention claimed is:

1. A suspension spring and snubber assembly for reducing transmitted noise from a reciprocating compressor at ⅓-octave frequency band of 500 Hz and preventing the occurrence of resonance frequency during the operation of the reciprocating compressor, the assembly comprising:

a suspension spring comprising a plurality of coils and having two opposing open ends which define a circular tubular space within their helix shape; and a cylindrical snubber secured to a supporting member of the reciprocating compressor for maintaining the integrity and shape of the suspension spring and for preventing displacement of the suspension spring from its intended position;

wherein the cylindrical snubber has a body and a groove at or near the base of the body, wherein the groove has an outer diameter that is smaller than that, of the body;

wherein one of the two opposing open ends of the suspension spring comprises at least one end coil having an internal diameter that is smaller than that of the non-end coils of the plurality of coils, and smaller than the outer diameter of the body of the cylindrical snubber, but larger than the outer diameter of the groove of the cylindrical snubber; and wherein the non-end coils of the plurality of coils have an internal diameter that is larger than the outer diameter of the body of the cylindrical snubber;

so that when the cylindrical snubber and the suspension spring are assembled, the at least one end coil is loosely fitted over the groove and the non-end coils of the plurality of coils are loosely fitted over the body of the cylindrical snubber such that the physical contact between the suspension spring and the cylindrical snubber is eliminated or minimized during operation.

2. The assembly in accordance with claim 1, wherein said suspension spring is magnetized so that the magnetized suspension spring minimizes the suspension spring from slipping off the snubber.

3. A system for reducing transmitted noise from a reciprocating compressor at ⅓-octave frequency band of 500 Hz and preventing the occurrence of resonance frequency during the operation of the reciprocating compressor, the system comprising:

a plurality of suspension springs each comprising a plurality of coils and having two opposing open ends for supporting a compressor assembly of the reciprocating compressor;

a plurality of upper cylindrical snubbers to mounted on a bottom side of the compressor assembly; and a plurality of lower cylindrical snubbers mounted on a mount;

wherein the plurality of upper cylindrical snubbers are substantially aligned with the plurality of lower cylindrical snubbers, the plurality of suspension springs having their two opposing open ends fitted separately to the plurality of upper cylindrical snubbers and the plurality of lower cylindrical snubbers;

wherein each of the plurality of lower cylindrical snubbers has a body and a groove at or near the base of the body, wherein the groove has an outer diameter that is smaller than that of the body;

wherein one of the two opposing open ends comprises at least one end coil having an internal diameter that is smaller than that of the non-end coils of the plurality of coils but larger than the outer diameter of the groove of the cylindrical snubber; and wherein the non-end coils of the plurality of coils have an internal diameter that is larger than the outer diameter of the body of the plurality of lower cylindrical snubbers;

so that when the cylindrical snubber and the suspension spring are assembled, the at least one end coil is loosely fitted over the groove and the non-end coils of the plurality of coils are loosely fitted over the body of the cylindrical snubber such that the physical contact between the suspension spring and the cylindrical snubber is eliminated or minimized during operation.

4. The system in accordance with claim 3, wherein at least one of said plurality of suspension springs is magnetized so that the magnetized suspension spring prevents the suspension spring from slipping off the associated lower snubbers.

* * * * *